US009570848B1

(12) United States Patent
Suarez

(10) Patent No.: US 9,570,848 B1
(45) Date of Patent: Feb. 14, 2017

(54) ELECTRICAL PLUG AND CORD KIT FOR HAIR CLIPPERS

(71) Applicant: Jose Suarez, Pompton Lakes, NJ (US)

(72) Inventor: Jose Suarez, Pompton Lakes, NJ (US)

( * ) Notice: Subject to any disclaimer, the term of this patent is extended or adjusted under 35 U.S.C. 154(b) by 0 days.

(21) Appl. No.: 14/982,208

(22) Filed: Dec. 29, 2015

(51) Int. Cl.
*H01R 13/04* (2006.01)
*H01R 13/629* (2006.01)
*B26B 19/38* (2006.01)

(52) U.S. Cl.
CPC ..... *H01R 13/629* (2013.01); *B26B 19/3806* (2013.01); *B26B 19/3873* (2013.01); *H01R 13/04* (2013.01)

(58) Field of Classification Search
CPC . H01R 13/629; H01R 13/506; H01R 13/6335; H01R 13/04; H01R 24/28; B26B 19/3806; B26B 19/205; B26B 19/3873; B60L 11/1818
USPC ..... 439/692
See application file for complete search history.

(56) References Cited

U.S. PATENT DOCUMENTS 4,927,376 A * 5/1990 Dickie ..... H01R 24/28 439/484
5,057,036 A * 10/1991 Dickie ..... H01R 13/6335 439/484
5,234,360 A 8/1993 Kramer, Jr.
5,752,850 A * 5/1998 Ziegler ..... H01R 13/6335 439/484
D416,860 S 11/1999 Seiwert
6,042,418 A 3/2000 Cummings
6,305,388 B1 10/2001 Zeller
7,052,309 B1 * 5/2006 Chen ..... H01R 13/6335 439/484
7,063,558 B1 * 6/2006 Chen ..... H01R 13/6335 439/483
7,210,960 B2 5/2007 Mak
7,992,303 B2 * 8/2011 Liao ..... B26B 19/205 30/200
8,641,443 B1 * 2/2014 Moussa ..... H01R 13/6335 439/484
9,461,399 B2 * 10/2016 Seelig ..... H01R 13/506
2003/0141840 A1 7/2003 Sanders
2013/0012054 A1 * 1/2013 Andresen ..... B60L 11/1818 439/476.1
2014/0033531 A1 2/2014 Griffith

FOREIGN PATENT DOCUMENTS

WO WO2010014227 A1 2/2010

* cited by examiner

*Primary Examiner* — Jean F Duverne

(57) ABSTRACT

The electrical plug and cord kit for hair clippers is adapted for use with electrically powered hair dressing equipment. Specifically, the electrical plug and cord kit for hair clippers is a plug and cable designed to provide electric power for use by electrically powered hair dressing equipment and especially for use by clippers. The use of a pluggable power system reduces the station requirements for electrical outlets and further reduces the need for organizing a plurality of cables at the station. The electrical plug and cord kit for hair clippers comprises a plug housing, a plug connector, a handle housing, and a hanging loop.

5 Claims, 4 Drawing Sheets

ELECTRICAL PLUG AND CORD KIT FOR HAIR CLIPPERS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of coupling devices for electrical lines or cables, more specifically, plug system configured for use with hairdressing or shaving equipment.

SUMMARY OF INVENTION

The electrical plug and cord kit for hair clippers is adapted for use with electrically powered hair dressing equipment. Specifically, the electrical plug and cord kit for hair clippers is a plug and cable designed to provide electric power for use by electrically powered hair dressing equipment and especially for use by clippers. The use of a pluggable power system reduces the station requirements for electrical outlets and further reduces the need for organizing a plurality of cables at the station.

These together with additional objects, features and advantages of the electrical plug and cord kit for hair clippers will be readily apparent to those of ordinary skill in the art upon reading the following detailed description of the presently preferred, but nonetheless illustrative, embodiments when taken in conjunction with the accompanying drawings.

In this respect, before explaining the current embodiments of the electrical plug and cord kit for hair clippers in detail, it is to be understood that the electrical plug and cord kit for hair clippers is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the electrical plug and cord kit for hair clippers.

It is therefore important that the claims be regarded as including such equivalent construction insofar as they do not depart from the spirit and scope of the electrical plug and cord kit for hair clippers. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
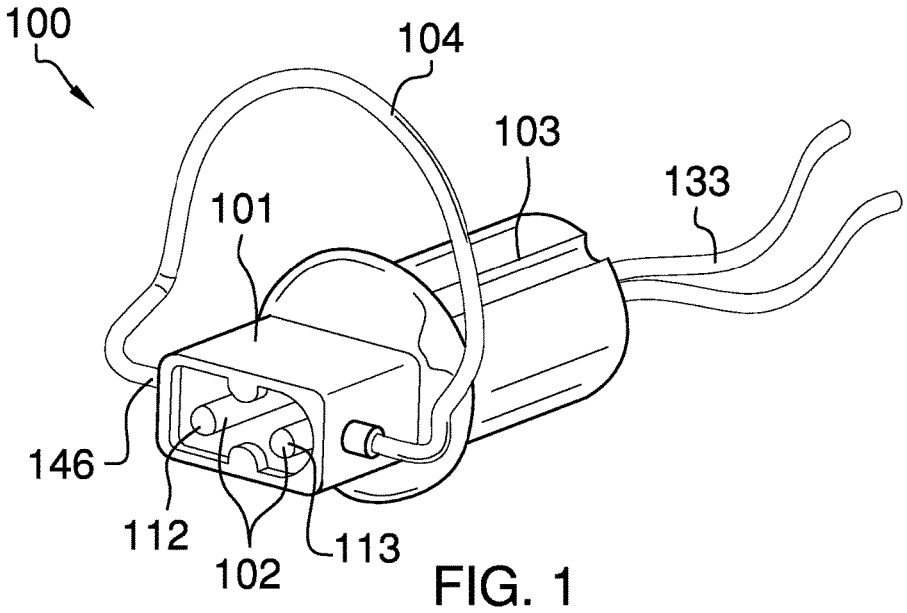
FIG. 1 is a perspective view of an embodiment of the disclosure.
Figure 2:
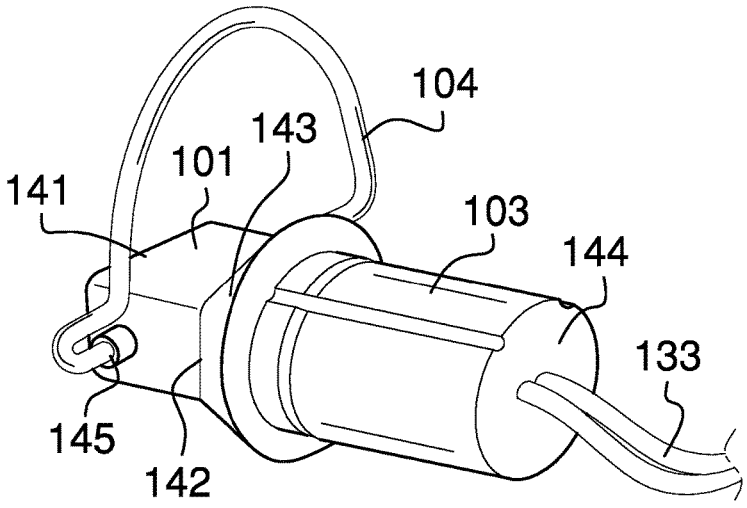
FIG. 2 is a back view of an embodiment of the disclosure.
Figure 3:
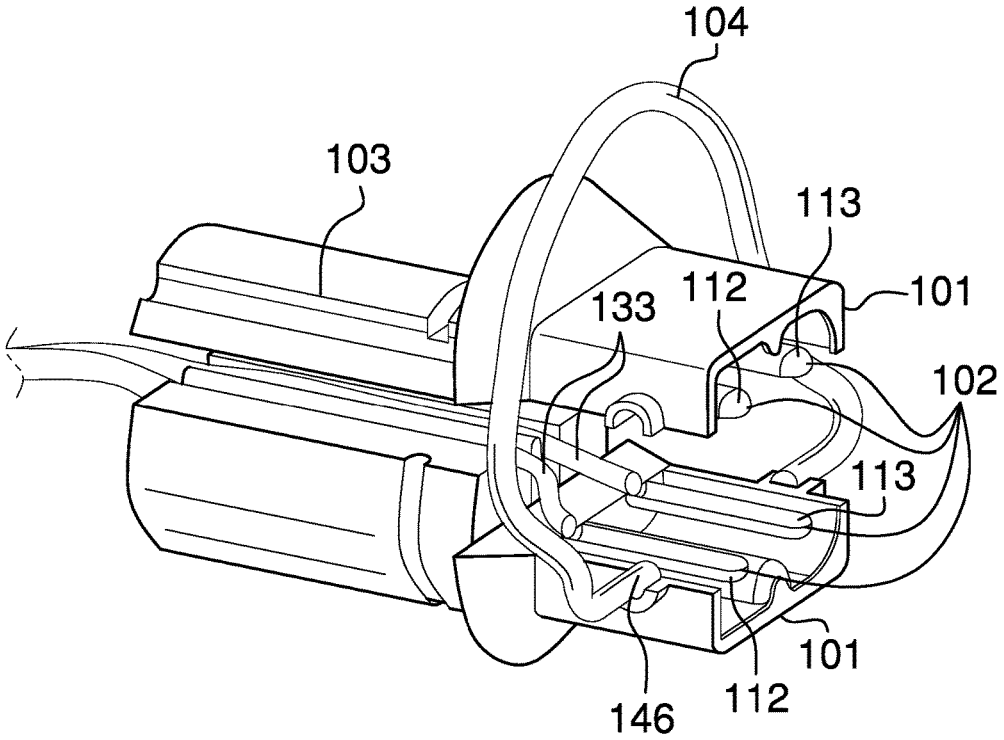
FIG. 3 is an exploded view of an embodiment of the disclosure.
Figure 4:
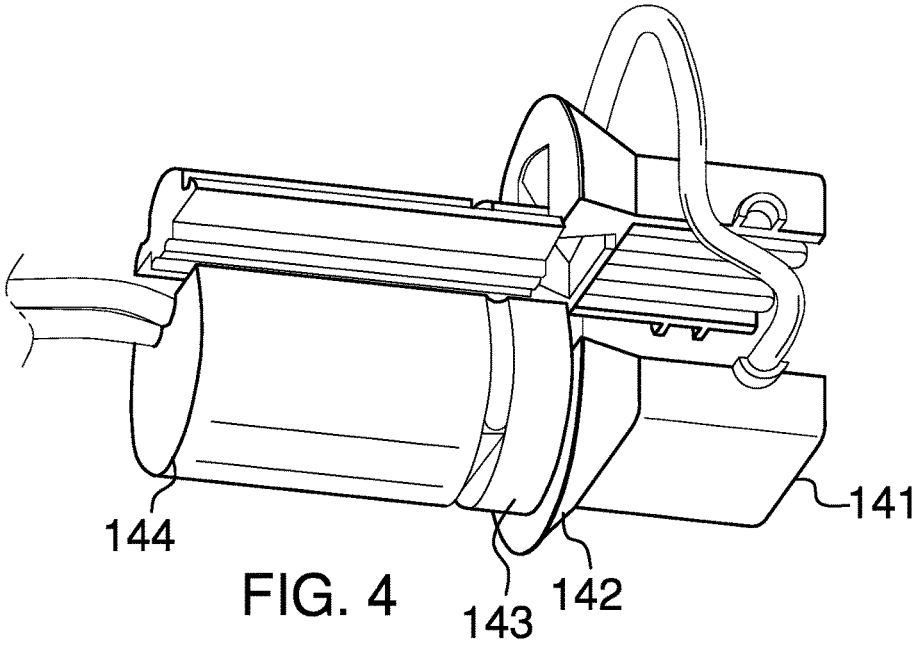
FIG. 4 is an exploded view of an embodiment of the disclosure.
Figure 5:
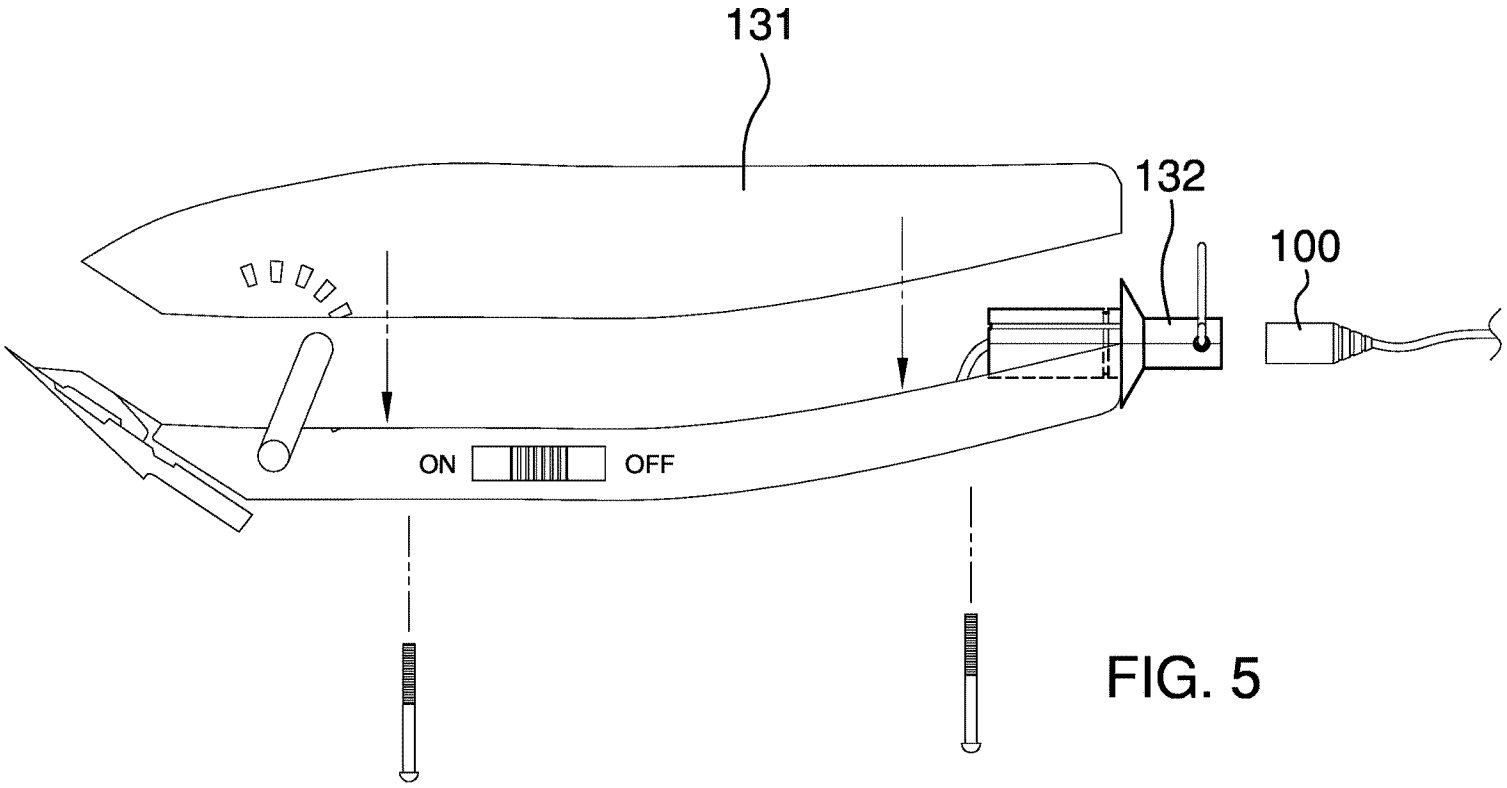
FIG. 5 is an in use view of an embodiment of the disclosure.

Detailed reference will now be made to a first potential embodiment of the disclosure, which is illustrated in FIGS. 1 through 5.

The electrical plug and cord kit for hair clippers 100 (hereinafter invention) comprises a plug housing 101, a plug connector 102, a handle housing 103, and a hanging loop 104. The invention 100 is adapted for use with electrically powered hair dressing equipment 131. The invention 100 is adapted to work with a port 132 that is installed on the hair dressing equipment 131. The invention 100 is further adapted to work with a cable 133 that is adapted to plug into an electrical outlet connected to the national electric grid. Specifically, the invention 100 is a plug and cable 133 designed to provide electric power from an electrical outlet for use by electrically powered hair dressing equipment 131 and especially for use by hair clippers. The use the invention 100 reduces the station requirements for electrical outlets and further reduces the need for organizing a plurality of cables at the station.

The plug housing 101 is a hollow rigid casing that encloses and within which is mounted the plug connector 102. The plug housing 101 further comprises a first end 141 and a second end 142. The plug connector 102 further comprises a plurality of conductors 111. The plurality of conductors 111 are received by the port 132 of the hair dressing equipment 131 such that when the first end 141 of the plug housing 101 is plugged into the port 132 the plurality of conductors 111 completes an electrical connection from the hair dressing equipment 131 to the national electric grid through the invention 100. The plurality of conductors 111 are connected to the cable 133 within the handle housing 103. The shape and form 101 of the plug housing 101 is designed to be received by the port 132 of the hair dressing equipment 131.

The handle housing 103 is hollow rigid casing that is formed in the shape of a hollow cylinder. The handle housing 103 is further defined with a third end 143 and a fourth end 144. The cylindrical form of the handle housing 103 allows the handle housing 103 to be used as a grip. The cable 133 is inserted through the fourth end 144 of handle housing 103 and is connected to the plurality of conductors 111 within the interior of the handle housing 103. The third end 143 of the handle housing 103 is attached to the second end 142 of the plug housing 101 such that the plug housing 101 projects perpendicularly away from the face of the third end 143 of the handle housing 103.

The hanging loop 104 is a flexible cylindrical structure that is attached to the handle housing 103. The hanging loop 104 is further defined with a fifth end 145 and a sixth end 146. The fifth end 145 or the hanging loop 104 is attached to the curved surface of the handle housing 103. The sixth end 146 of the hanging loop 104 is attached to the handle housing 103 such that the hanging loop 104 forms a loop that can be used to hang the invention 100 from a hook.

To use the invention 100, the plug housing 101 is plugged into the port 132 of a first piece of hair dressing equipment 131. The first piece of hair dressing equipment 131 is used normally. When the use of the first piece of hair dressing equipment 131 has ended, the plug housing is removed from the port 132 of the first piece of hair dressing equipment 131 and is subsequently plugged into the port 132 of a second piece of hair dressing equipment 131.

In the first potential embodiment of the disclosure, the plug housing 101, the handle housing 103, and the hanging loop 104 are molded from plastic. Suitable plastic includes, but are not limited to, high density polyethylene, polyvinylchloride, or polycarbonate. The plurality of conductors 111 are commercially available electrical conductors. The plurality of connectors 111 further comprise a first conductor 112, and a second conductor 113. In alternate embodiments of the disclosure, the plurality of conductors 111 can further comprise a third conductor.

The following definitions were used in this disclosure:

Cable: As used in this disclosure, a cable is a collection of insulated wires covered by a protective casing that is used for transmitting electricity or telecommunication signals.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder like structure. When the center axes of two cylinder like structures share the same line they are said to be aligned. When the center axes of two cylinder like structures do not share the same line they are said to be offset.

Cylinder: As used in this disclosure, a cylinder is a geometric solid defined by two identical flat and parallel ends that are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Housing: As used in this disclosure, a housing is a rigid casing that encloses and protects one or more devices.

Jack: As used in this disclosure, a jack is a port that is designed to receive a plug in order to make an electrical connection.

Plug: As used in this disclosure, a plug is a device at the end of an electrical cord that connects the cord to an electrical device or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An electrical connection comprising:

a plug housing, a plug connector, a handle housing, and a hanging loop;

wherein the electrical connection is adapted for use with electrically powered hair dressing equipment;

wherein the is adapted to work with a port that is installed on a hair dressing equipment;

wherein the electrical connection is further adapted to work with a cable that is adapted plugs into an electrical outlet connected to a national electric grid;

wherein the electrical connection is designed to provide electric power from the electrical outlet for use by electrically powered the hair dressing equipment;

wherein the plug housing is a hollow rigid casing that encloses and within which is mounted the plug connector;

wherein the plug housing further comprises a first end and a second end;

wherein the plug connector further comprises a plurality of conductors;

wherein the plurality of conductors are adapted to be received by the port of the hair dressing equipment;

wherein the plurality of conductors are adapted to be received by the port of the hair dressing equipment such that when the first end of the plug housing is plugged into the port of the plurality of conductors completes an electrical connection from the hair dressing equipment to the national electric grid through the electrical connection;

wherein the plurality of conductors are connected to the cable within the handle housing;

wherein the shape and form of the plug housing is designed to be received by the port of the hair dressing equipment;

wherein the handle housing is hollow rigid casing that is formed in the shape of a cylinder;

wherein the cable is inserted through a fourth end of handle housing and is connected to the plurality of conductors within the interior of the handle housing;

wherein the third end of the handle housing is attached to the second end of the plug housing such that the plug housing projects perpendicularly away from the face of the third end of the handle housing.

2. The electrical connection according to claim 1 wherein the hanging loop is a flexible cylindrical structure that is attached to the handle housing;

wherein the hanging loop is further defined with a fifth end and a sixth end;

wherein the fifth end or the hanging loop is attached to the curved surface of the handle housing;

wherein the sixth end of the hanging loop is attached to the handle housing such that the hanging loop forms a loop.

3. The electrical connection according to claim 2 wherein the electrically powered hair dressing equipment are hair clippers.

4. An electrical connection comprising:

a plug housing, a plug connector, a handle housing, and a hanging loop;

wherein the electrical connection is adapted for use with electrically powered hair clippers;

wherein the is adapted to work with a port that is installed on a hair dressing equipment;

wherein the electrical connection is further adapted to work with a cable that is adapted plugs into an electrical outlet connected to a national electric grid;

wherein the electrical connection is designed to provide electric power from the electrical outlet for use by electrically powered the hair dressing equipment;

wherein the plug housing is a hollow rigid casing that encloses and within which is mounted the plug connector;

wherein the plug housing further comprises a first end and a second end;

wherein the plug connector further comprises a plurality of conductors;

wherein the plurality of conductors are adapted to be received by the port of the hair dressing equipment;

wherein the plurality of conductors are adapted to be received by the port of the hair dressing equipment such that when the first end of the plug housing is plugged into the port of the plurality of conductors completes an electrical connection from the hair dressing equipment to the national electric grid through the electrical connection;

wherein the plurality of conductors are connected to the cable within the handle housing;

wherein the handle housing is hollow rigid casing that is formed in the shape of a cylinder;

wherein the cable is inserted through a fourth end of handle housing and is connected to the plurality of conductors within the interior of the handle housing;

wherein a third end of the handle housing is attached to a second end of the plug housing such that the plug housing projects perpendicularly away from the face of the third end of the handle housing.

5. The electrical connection according to claim 4 wherein the hanging loop is a flexible cylindrical structure that is attached to the handle housing;

wherein the hanging loop is further defined with a fifth end and a sixth end;

wherein the fifth end or the hanging loop is attached to the curved surface of the handle housing;

wherein the sixth end of the hanging loop is attached to the handle housing such that the hanging loop forms a loop.

* * * * *